US005188752A

United States Patent [19]

Prencipe et al.

[11] Patent Number: 5,188,752

[45] Date of Patent: * Feb. 23, 1993

[54] LINEAR VISCOELASTIC AUTOMATIC DISHWASHER COMPOSITIONS CONTAINING A CROSSLINKED METHYL VINYL ETHER/MALEIC ANHYDRIDE COPOLYMER

[75] Inventors: Michael Prencipe, E. Windsor; Elizabeth F. McCandlish, Highland Park, both of N.J.; Frank J. Loprest, Langhorne, Pa.

[73] Assignee: Colgate-Palmolive Company, New York, N.Y.

[ * ] Notice: The portion of the term of this patent subsequent to Nov. 12, 2008 has been disclaimed.

[21] Appl. No.: 688,794

[22] Filed: Apr. 22, 1991

[51] Int. Cl.[5] ..... C11D 9/42; C11D 9/10; C11D 9/22

[52] U.S. Cl. ..... 252/96; 252/97; 252/103; 252/109; 252/132; 252/173; 252/174.23; 252/174.24; 252/DIG. 2; 252/DIG. 14

[58] Field of Search ..... 252/96, 97, 103, 109, 252/132, 173, 174.23, 174.24, DIG. 14, DIG. 2

[56] References Cited

U.S. PATENT DOCUMENTS

| | | | |
|---|---|---|---|
| 2,985,625 | 5/1961 | Jones | 526/261 |
| 3,060,124 | 10/1962 | Ginn | 252/135 |
| 3,684,722 | 8/1972 | Hynam et al. | 252/98 |
| 4,147,650 | 4/1979 | Sabatelli et al. | 252/103 |
| 4,226,736 | 10/1980 | Bush et al. | 252/135 |
| 4,752,409 | 6/1988 | Drapier et al. | 252/94 |
| 4,753,755 | 6/1988 | Gansser | 252/527 |
| 4,801,395 | 1/1989 | Chazard et al. | 252/99 |
| 4,824,590 | 4/1989 | Roselle | 252/90 |
| 4,836,946 | 6/1989 | Dixit | 252/97 |
| 4,836,948 | 6/1989 | Corring | 252/99 |
| 4,859,358 | 8/1989 | Gabriel et al. | 252/99 |
| 4,867,896 | 9/1989 | Elliott et al. | 252/94 |
| 4,889,653 | 12/1989 | Ahmed et al. | 252/99 |

*Primary Examiner*—A. Lionel Clingman
*Assistant Examiner*—William S. Parks
*Attorney, Agent, or Firm*—Richard E. Nanfeldt; Robert C. Sullivan; Murray Grill

[57] ABSTRACT

A linear viscoelastic aqueous liquid automatic dishwasher detergent composition comprising water; up to about 2% by weight of long chain fatty acid or salt thereof; from about 0 to 5% by weight of organic detergent; from about 5 to 40% by weight of alkali metal detergent builder salt; up to about 20% by weight of a chlorine bleach compound; and 0.1 to 5.0% of a crosslinked copolymer of methyl vinyl ether and maleic anhydride which is crosslinked with at least about 0.5 weight % of an aliphatic diene having about 6 to about 20 carbon atoms.

7 Claims, No Drawings

LINEAR VISCOELASTIC AUTOMATIC DISHWASHER COMPOSITIONS CONTAINING A CROSSLINKED METHYL VINYL ETHER/MALEIC ANHYDRIDE COPOLYMER

FIELD OF THE INVENTION

The invention relates to aqueous linear viscoelastic (gel-like) liquid compositions which are especially useful as automatic dishwashing detergent compositions.

BACKGROUND OF THE INVENTION

Liquid automatic dishwashing detergent compositions have recently received much attention, and the aqueous products have achieved commercial popularity.

The acceptance and popularity of the liquid formulations as compared to the more conventional powder product stems from the convenience and performance of the liquid products. However, even the best of the currently available liquid formulations still suffer form two major problems: product phase instability and bottle residue, and to some extent, cup leakage from the dispenser cup of the automatic dishwashing machine.

Representative patent art in this area includes Rek U.S. Pat. No. 4,556,504; Bush et al. U.S. Pat. No. 4,226,736; Ulrich U.S. Pat. No. 4,431,559; Sabatelli U.S. Pat. No. 4,147,650; Paucot U.S. Pat. No. 4,079,015; Leikhem U.S. Pat. No. 4,116,849; Milora U.S. Pat. No. 4,521,332; Jones U.S. Pat. No. 4,597,889; Heile U.S. Pat. No. 4,512,908; Laitem U.S. Pat. No. 4,753,748; Sabatelli U.S. Pat. No. 3,579,455; Hynam U.S. Pat. No. 3,684,722. Other patents relating to thickened aqueous detergent compositions include Ginn U.S. Pat. No. 3,060,124, U.S. Pat. No. 3,985,668; U.K. Patent Applications GB 2,116,199A and GB 240,450; U.S. Pat. No. 4,511,487; Drapier, et al. U.S. Pat. No. 4,752,409; U.S. Pat. No. Drapier, et al. 4,801,395; Ahmed et al. U.S. Pat. No. 4,889,653. Commonly assigned co-pending patents include, for example, Ser. No. 427,912 filed Oct. 24, 1989; Ser. No. 924,385, filed Oct. 29, 1986; Ser. No. 323,138, filed Mar. 13, 1989; Ser. No. 328,716, filed Mar. 27, 1989; Ser. No. 323,137, filed Mar. 13, 1989; Ser. No. 323,134, filed Mar. 13, 1989.

The solubilizing effect of potassium salts on sodium tripolyphosphate in aqueous detergent compositions is described in Smeets U.S. Pat. No. 3,720,621. This patent describes homogeneous liquid compositions containing 14 to 35 percent sodium tripolyphosphate, 0.1 to 50 percent of potassium and/or ammonium salt of an inorganic or organic acid, water, and optional surfactants, solubilizing agent, organic sequestering agent and other adjuvants.

Corring U.S. Pat. No. 4,836,948 discloses a viscoelastic gel detergent composition characterized by its viscosity under low and high shear conditions, pH, and steady state viscoelastic deformation compliance. The composition requires the presence of a polycarboxylate polymeric thickener, preferably a cross-linked polyacrylic acid. The compositions of this patent also, however, require a trivalent metal containing material, especially an aluminum containing material such as alumina. The compositions may further include a structuring chelant which may be a salt of carbonate, pyrophosphate or mixture thereof, and preferably the potassium salts.

The recently issued U.S. Pat. No. 4,859,358 discloses the incorporation of metal salts of long chain hydroxy fatty acids, as anti-tarnishing agents, which do not affect the viscosity of the compositions in thickened aqueous automatic dishwasher detergent compositions. The thickeners for these compositions may be a high molecular weight polycarboxylate polymer, such as those sold under the Carbopol trade name, and specific 600 and 900 series resins are mentioned. It is also disclosed that the compositions include entrained gas, e.g. air bubbles to further ensure stability. Amounts of air in the range of from about 1% to 20%, preferably from about 5 to 15% by volume, will lower the specific gravity of the overall composition to within from about 5% more than to about 10% less than, preferably from 1% more than to 5% less than, the specific gravity of the aqueous phase. In Example III of this patent, the specific gravity of the composition was stated to be 1.32 g/cm$^3$. The compositions are not described as being linear viscoelastic and as exemplified do not include any potassium salts.

While the compositions disclosed in U.S. Ser. No. 353,712 provided a satisfactory solution to the problems of phase instability, bottle residue and cup leakage, it has now been found that under some storage and handling conditions and/or processing conditions, additional improvements would be desirable. Specifically, if the viscoelastic composition is subjected to repeated heating and cooling cycles, growth of crystals and product thinning and/or precipitate formation has been observed.

As a result of these problems, the finished product not only may be perceived as unaesthetic but, more importantly, the product viscosity is often lowered which in turn may lead to cup leakage and corresponding degradation in cleaning performance.

SUMMARY OF THE INVENTION

The present invention related to an improved aqueous liquid automatic dishwashing detergent composition (abbreviated LADD) which is characterized by its linear viscoelastic behavior, excellent stability against phase separation, excellent stability against settling of dissolved or suspended particles under high and low temperature conditions, low levels of bottle residue, relatively high bulk density, substantial absence of loosely bound water, superior aesthetics, improved optical properties, freedom from fish-eyes, absence of crystal formation and growth, and resistance to cup leakage of less than about 10 wt %.

The present invention relates to an automatic dishwashing composition which contains a cross-linked, methyl vinyl ether/maleic anhydride polymeric thickening agent (referred to as cross-linked Gantrez) that is exceptionally stable to the high bleach, salt, and alkali levels found in automatic dishwashing detergent. In addition, the composition formed is temperature-stable. Furthermore, by controlling the conditions of mixing the ingredients of the compositions, and by controlling the method of dispersion, and by controlling the pH and temperature of the aqueous solution of the polymeric thickener, the formation of fish-eyes and loss of viscosity with time can be minimized.

It is thought that if the gel forming polymer were surface active, in addition to its function as a structuring agent, that it would make a contribution toward reduced spotting and filming on glassware. This would be possible if nonionic-like groups were appended to the polymer, causing it to have increased surfactant properties. Ordinarily it is not possible to incorporate classical nonionics into a liquid automatic dish detergent because the nonionics react with the hypochlorite bleach. In the case of cross-linked Gantrez, the $OCH_3$ groups on every repeating unit contribute a chemical functionality like that of the ethoxy groups on ethoxylated nonionic surfactants. For example, a dilute solution (0.05%) of cross-linked Gantrez shows a lower surface tension, by about 4 dynes/cm, than a solution of Carbopol 614 under the same circumstances. Surprisingly, these groups do not contribute to loss of available chlorine, but rather compositions containing them show the same chlorine stability as those without.

Another advantage the the cross-linked Gantrez polymer used in the instant compositions has over Carbopol is that it is much easier to disperse. It is well known that Carbopol is hard to disperse. BF Goodrich suggests the use of an eductor and other specialized procedures to get good dispersions. The problem arises because Carbopol is so hydrophilic that the individual particles swell and the particles clump to form aggregates. When dispersion is attempted, the outside of the aggregate hydrates and swells. The inside is no longer readily contacted with water. This causes fish eyes and regions of inhomogeneity that are very hard to remove by further mixing. The fish eyes and inhomogeneous dispersion persist in the final product. The result is decreased control over the final rheological properties of the product and increased batch to batch variation. These variations are readily perceived by the end user and are interpreted as poor quality product.

In contrast, in cross-linked Gantrez the aggregates, if any, that form are readily broken up by mechanical action before the particle swells and gelation occurs. The reason, it is believed, is the presence of the maleic anhydride ring in the polymer.

This causes a great decrease in the water seeking character of the polymer and permits preliminary dispersion to occur by mechanical action. In time, the maleic anhydride ring hydrolyzes, the carboxylate groups are freed, and the polymer swells and gels into a viscoelastic substance. The ease of dispersion is reflected in lack of fish eyes, more homogeneous final product, and a more reliable manufacturing process.

Accordingly, the present invention provides an improved linear viscoelastic aqueous liquid automatic dishwashing detergent composition comprising water; up to about 2% by weight of long chain fatty acid or salt thereof; from about 0 to 5% by weight of low foaming, chlorine bleach stable surfactant; from 0 to 3% by weight of a chlorine bleach-stable foam depressant; from about 5 to about 40% by weight of alkali metal detergent builder salt; from about 0 to about 20% by weight of a chlorine bleach compound; and from about 0.1 to about 5% by weight of a cross-linked polymeric thickening agent, wherein the compositions preferably have a bulk density of from about 1.28 g/cm$^3$ to about 1.42 g/cm$^3$.

in a preferred embodiment, the linear viscoelastic aqueous LADD comprises, approximately, by weight, (a) 5 to 40% phosphate detergent builder such as sodium tripolyphosphate;
(b) 5 to 15% alkali metal silicate;
(c) 0 to 8% alkali metal hydroxide;
(d) 0 to 5% water-dispersible organic detergent active material of the type that is stable to chlorine bleach;
(e) 0 to 1.5% chlorine bleach stable foam depressant;
(f) chlorine bleach compound in an amount sufficient to provide about 0.2 to 4% of available chlorine;
(g) 0.1 to 5.0% hydrophilic cross-linked water-dispersible thickening agent to provide said linear viscoelastic property;
(h) 0.08 to 0.4% of long chain fatty acid or a metal salt of a long chain fatty acid to increase the physical stability of the composition;
(i) 0 to 10% of a non-cross-linked polyacrylic acid having a molecular weight in the range of from about 800 to 200,000; and
(j) water wherein the entire composition has a cup leakage of less than 10 wt %, more preferably less than 8 wt %, and most preferably less than 6 wt %.

DESCRIPTION AND PREFERRED EMBODIMENTS

The compositions of this invention are thickened aqueous liquids containing various cleansing active ingredients, detergent builder salts and other detergent adjuvants, structuring and thickening agents and stabilizing components, although some ingredients may serve more than one of these functions.

The advantageous characteristics of the compositions of this invention include: 1) improved optical properties, 2) physical stability such as manifested by little or no phase separation, solid settling or viscosity change over time, 3) little or no settling and/or viscosity change resulting from temperature variations, 4) low bottle residue, 5) low cup leakage of less than 10 wt %, 6) high cleaning performance, e.g. low spotting and filming, low dirt residue, 7) consistency in product characteristics performance, 8) superior aesthetics, 9) easier manufacturing process conditions than compositions made with Carbopol resins, and 10) improved biodegradability. These characteristics are believed to be attributed to several interrelated factors such as low undissolved particulate content, product density and linear viscoelastic rheology. These factors are, in turn, dependent on several critical compositional components and processing conditions of the formulations, namely, (1) the inclusion of a cross-linked polymeric thickening agent that is stable to alkali, bleach and salt, in an amount effective for thickening and that has a high water absorption capacity, exemplified by a copolymer of methyl vinyl ether/maleic anhydride which is cross-linked with a diene such as Octadiene (2) inclusion of a physical stabilizing amount of a long chain fatty acid or salt thereof, and (3) a product bulk density of at least about 1.28 g/cc, especially at least 1.32 g/cc and (4) maintaining the pH of the neutralized polymeric thickener at a pH of at least 11, more preferably at least 11.5.

In particular, the linear viscoelastic aqueous liquid automatic dishwashing detergent compositions of this invention will, at least in the preferred embodiments, satisfy each of the following stability criteria over the aging temperature-time schedule shown by the following Table I:

TABLE I

| Aging Temperature (°F.) | Minimum Duration (Weeks) |
|---|---|
| 140 | >1 |
| 120 | >4 |
| 100 | >12 |
| 77 | >21 |

More specifically, the compositions are considered stable if each of the following stability criteria is satisfied for at least the minimum number of weeks for each aging temperature shown in Table I:

no visible phase separation (i.e. no solid/liquid separation)

no significant change in viscosities, yield stress or other dynamic-mechanical properties, no decolorization or significant color change.

In addition to the above stability criteria, the compositions of this invention are further characterized by their low bottle residue and cup leakage. Specifically, for the preferred thickened compositions of this invention, bottle residues, under the usual use conditions, will be no more than about 6 to 8%, preferably no more than about 4 to 5%, of the original bottle contents, on a weight basis.

The polymeric thickening agents contribute to the linear viscoelastic rheology of the invention compositions. As used herein, "linear viscoelastic" or "linear viscoelasticity" means that the elastic (storage) modulus (G') and the viscous (loss) modulus (G'') are both substantially independent of strain, at least in an applied strain range of from 0–50%, and preferably over an applied strain range of from 0 to 80%. More specifically, a composition is considered to be linear viscoelastic for purposes of this invention, if over the strain range of 0–50% the elastic modulus G' has a minimum value of 100 dynes/sq.cm., preferably at least 250 dynes/sq.cm., and varies less than about 500 dynes/sq.cm., preferably less than 300 dynes/sq.cm., especially less than 100 dynes/sq.cm. Preferably, the minimum value of G' and maximum variation of G' applies over the strain range of 0 to 80%. Typically, the variation in loss modulus G'' will be less than that of G'. As a further characteristic of the preferred linear viscoelastic compositions the ratio of G''/G' (Tanδ) is less than 1, preferably less than 0.8, but more than 0.05, preferably more than 0.2, at least over the strain range of 0 to 50%, and preferably over the strain range of 0 to 80%. It should be noted in this regard that % strain is shear strain × 100%.

By way of further explanation, the elastic (storage) modulus G' is a measure of the energy stored and retrieved when a strain is applied to the composition while viscous (loss) modulus G'' is a measure of the amount of energy dissipated as heat when strain is applied. Therefore, a value of Tanδ

$$0.05 < \text{Tan}\delta < 1.$$

preferably $$0.2 < \text{Tan}\delta < 0.8$$

means that the compositions will retain sufficient energy when a stress or strain is applied, at least over the extent expected to be encountered for products of this type, for example, when poured from or shaken in the bottle, or stored in the dishwasher detergent dispenser cup of an automatic dishwashing machine, to return to its previous condition when the stress or strain is removed. The compositions with Tan S values in these ranges, therefore, will also have a high cohesive property, namely, when a shear or strain is applied to a portion of the compositions to cause it to flow, the surrounding portions will follow. As a result of this cohesiveness of the linear viscoelastic characteristic, the compositions will readily flow uniformly and homogeneously from a bottle, when the bottle is tilted, thereby contributing to the physical (phase) stability of the formulation and the low bottle residue (low product loss in the bottle) which characterized the compositions of this invention. The linear viscoelastic property also contributes to improved physical stability against phase separation of any undissolved suspended particles by providing a resistance to movement of the particles due to the strain exerted by a particle on the surrounding fluid medium. Linear viscoelasticity also contributes to the elimination of dripping of the contents, when the product is poured from a bottle and hence reduction of formation of drops around the container mouth at the conclusion of pouring the product from a container.

It has previously been found in connection with other types of thickened aqueous liquid automatic dishwashing detergent compositions that agglomeration or escape of incorporated air bubbles could be avoided by incorporating certain surface active ingredients, especially higher fatty acids and the salts thereof, such as stearic acid, behenic acid, palmitic acid, sodium stearate, aluminum stearate, and the like.

Therefore, in the present invention, in order to avoid stabilization of air bubbles which may become incorporated into the compositions during normal processing, such as during various mixing steps, the surface active ingredients are post-added to the remainder of the composition, under low shear conditions using mixing devices designed to minimize cavitation and vortex formation.

The surface active ingredients present in the composition will include the main detergent surface active cleaning agent, and will also preferably include antifoaming agent (e.g. phosphate ester) and higher fatty acid or salt thereof as a physical stabilizer.

Certain classes of polymers can be lightly cross-linked to give gels in aqueous systems. These gels have strong elastic character, are able to suspend solids, resist syneresis on aging, and have other desirable physical properties for use in consumer products. Desirable properties for an automatic dishwasher detergent include: 1) ease of dispensing from a bottle (easily shear-thinned) 2) high yield value (so the product will not run out of the detergent dispenser cup in the door of the dishwasher 3) good maintenance of viscosity on aging, especially in the presence of a high concentration of inorganic salts and 4) resistance to oxidation by components of the formula containing available chlorine. The preferred polymers to impart these properties are lightly cross-linked so that they tend to swell and form strong three-dimensional networks in aqueous systems.

One such class of polymers is based on methyl vinyl ether/maleic anhydride copolymers and terpolymers. Examples of useful polymers are: methyl vinyl ether, maleic anhydride, acrylic acid, cross-linked; methyl vinyl ether, maleic anhydride, vinyl pyrrolidone, cross-linked; and methyl vinyl ether, maleic anhydride, isobutene, cross-linked. The cross-linking agent is essential to establish the kind of polymer network useful in this invention. The cross-linking agent can be any hydrocarbon with a chain length of four or more carbon atoms containing at least two carbon-carbon double bonds. The cross-linking agent is mainly a hydrocarbon with optional halogen and oxygen-containing substituents and linkages such as ester, ether and OH groups. These cross-linking agents can vary in amount from 0.01 to 30% by weight of the total quantity of polymer used. Examples of cross-linking agents are 1,7-Octadiene, 1,9

Decadiene, non-terminal dienes, Divinyl Glycol, Butane Divinylether, polyallyl pentaerythritol and polyallyl sucrose. Cross-linking can also be achieved through the maleic anhydride after the polymer is formed, via ester or amide formation using polyols and polyamines such as 1,4 butane diol and polyethylene glycols.

The most useful polymers of these inventions are the Gantrez AN cross-linked with aliphatic dienes such as 1,7 octadiene and 1,9 decadiene.

Gantrez AN polymers cross-linked from 0.01 to 10% by weight of 1,7 octadiene were shaken overnight in order to hydrolyze the maleic anhydride ring. The polymer solutions were neutralized to pH 7 to fully ionize the carboxyl groups. The results show that 5% by weight of cross-linking agent is necessary before a gel is formed. If Gantrez AN is cross-linked with 1,9 decadiene then a gel is formed at 3–4% cross-linking.

The cross-linking causes the formation of a polymer that disperses in water to form a gel with a yield point. Table II gives typical yield points for the polymer cross-linked with 1,9 decadiene.

TABLE II

Yield Point[a] as a Function of Polymer Concentration in Water for Cross-linked Gantrez (Gantrez ACV-4006 cross-linked with 1,9 Decadiene).

| Polymer Concentration (Weight %) | pH | Yield Point, Pa |
|---|---|---|
| 0.125 | 7 | 37 |
| 0.250 | 7 | 64 |
| 0.500 | 7 | 176 |

[a]Measurements were made using the Haake Rotoviscometer RV12 with MV IP sensor system. Shear rate was varied from 0 to 10 $sec^{-1}$.

Brookfield viscosity measurements were made using cross-linked Gantrez polymers, and results are summarized in Table III. Results show that even at very low concentrations, cross-linked Gantrez yield highly viscous polymer solutions. These viscosities characterize the degree of polymerization of the polymers.

TABLE III

Brookfield Viscosity[a] of 0.5% Cross-linked Gantrez (ACV-4006) in water at pH 7.

| Spindle # | RPM | Brookfield Viscosity (cps) |
|---|---|---|
| T-C | 1 | $376 \times 10^3$ |
| T-C | 2.5 | $180 \times 10^3$ |
| T-C | 5 | $105 \times 10^3$ |
| T-C | 10 | $59 \times 10^3$ |

[a]The measurements were taken with a Brookfield Model DV II.

The copolymer of methyl vinyl ether/maleic anhydride is illustrated by the following formula:

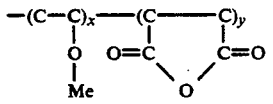

wherein x is about 50 mole %.

The copolymer is cross-linked with about 0.5 to about 20.0 wt % of a diene monomer having about 6 to about 20 carbon atoms, more preferably about 7 to 16 and most preferably about 8 to 12, wherein preferred diene monomers are 1,7 Octadiene and 1,9 decadiene. These water-dispersible, cross-linked thickening resins were obtained from the GAF corporation. The amount of the cross-linked polymeric thickening agent or other high molecular weight, hydrophilic cross-linked polycarboxylate thickening agent to impart the desired rheological property of linear viscoelasticity will generally be in the range of from about 1.5 to 5%, preferably from about 0.5 to 2.5, by weight, based on the weight of the composition, although the amount will depend on the particular cross-linking agent, ionic strength of the composition, hydroxyl donors and the like.

The inorganic detergent builder salts that are employed in the compositions of the instant invention are selected from the group consisting of sodium and potassium salts of polyphosphates, orthophosphates, carbonates, bicarbonates, sesquicarbonates and borates and aluminosilicates, wherein sodium tripolyphosphate (NaTPP) and potassium tripolypolyphosphate (KTPP) are especially preferred.

Organic detergent builders maybe used alone or in combination with the inorganic builder salts, wherein the organic builder salts are selected from the group consisting of sodium and potassium salts of citrates, nitrilotriacetates, oxydyacetates, carboxymethoxysuccinates, tetracarboxylates, and starch.

In accordance with the present invention, however, the detergent builder salts will be comprised of mixtures of at least potassium tripolyphosphate (KTPP) and sodium tripolyphosphate (NaTPP). Typical ratios (based upon weight) of KTPP to NaTPP are from about 1.4:1 to 10:1, especially from about 2:1 to 8:1. The total amount of detergent builder salts is preferably from about 10 to 35% by weight, more preferably from about 15 to 35% and most preferably from about 15 to 30% by weight of the composition. Of this total amount of the detergent builders at least 50% by weight (preferably at least about 8% by weight of the composition) will be KTPP and preferably at least 5% by weight (preferably at least 2% by weight of the composition) will be NaTPP. More preferably, the alkali metal detergent builder salt will be comprised of from about 65 to 95% by weight of KTPP, especially 75 to 90% of KTPP and from about 5 to 35% of NaTPP, especially 10 to 25% of NaTPP. In terms of the total composition, the amount of KTPP will be in the range of from about 8 to 25% by weight, preferably 15 to 22%, and the amount of NaTPP will be in the range of from about 2 to 10% by weight, preferably 3 to 8%.

When other alkali metal detergent builder salts are present in the formulation, they will usually be present in amounts less than 5% by weight based on the total composition and, in any case, in amounts to maintain the K/Na ratios to within the above described range.

The linear viscoelastic compositions of this invention may, and preferably will, contain a small, but effective, amount of a long chain fatty acid or monovalent or polyvalent salt thereof to stabilize the composition. Although the manner by which the fatty acid or salt contributes to the rheology and stability of the composition has not been fully elucidated it is hypothesized that it may function as a hydrogen bonding agent or cross-linking agent for the polymeric thickener.

The preferred long chain fatty acids are the higher aliphatic fatty acids having from about 10 to 50 carbon atoms, more preferably from about 12 to 40 carbon atoms, and especially preferably from about 14 to 40 carbon atoms, inclusive of the carbon atom of the carboxyl group of the fatty acid. The aliphatic radical may be saturated or unsaturated and may be straight or branched, wherein the aliphatic radical can have functional groups can be attached to the aliphatic radical, wherein the functional groups are selected from the group consisting of hydroxyl, ester, tertiary amines and dialkyl substituted amide groups. Straight chain saturated fatty acids are preferred. Mixtures of fatty acids may be used, such as those derived from natural sources, such as tallow fatty acid, coco fatty acid, soya fatty acid, etc., or from synthetic sources available from industrial manufacturing processes.

Thus, examples of the fatty acids include, for example, decanoic acid, dodecanoic acid, palmitic acid, myristic acid, stearic acid, isostearic acid, behenic acid, oleic acid, eicosanoic acid, tallow fatty acid, coco fatty acid, soya fatty acid, mixtures of these acids, etc. Stearic acid and mixed fatty acids, e.g. stearic acid/palmitic acid, are preferred.

Further improvements in phase stability, particularly under elevated temperature storage conditions, and maintenance of product viscosity levels can be obtained by using longer chain length fatty acids in the range of from $C_{18}$ to $C_{40}$. Either individual or mixtures of these longer chain length fatty acids can be used, however, the average chain length should be in the range of from about 20 to 32 carbon atoms, especially 24 to 30 carbon atoms and mixture of fatty acids encompassing this range are preferred. Suitable mixed fatty acids are commercially available, for instance those sold under the trade name Syncrowax by Croda.

When the free acid form of the fatty acid is used directly it will generally associate with the potassium and sodium ions in the aqueous phase to form the corresponding alkali metal fatty acid soap. However, the fatty acid salts may be directly added to the composition as sodium salt or potassium salt, or as a polyvalent metal salt, although the alkali metal salts of the fatty acids are preferred fatty acid salts. The preferred polyvalent metals are the di- and tri- valent metals of Groups IIA, IIB and IIIB, such as magnesium, calcium, aluminum and zinc, although other polyvalent metals, including those of Groups IIIA, IVA. VA. IB, IVB, VB, VIB, VIIB and VIII of the Periodic Table of the Elements can also be used. Specific examples of such other polyvalent metals include Ti, Zr, V, Nb, Mn, Fe, Co, Ni, Cd, Sn, Sb, Bi, etc. Generally, the metals may be present in the divalent to pentavalent state. Preferably, the metal salts are used in their higher oxidation states. Naturally, for use in automatic dishwashers, as well as any other applications where the invention composition will or may come into contact with articles used for the handling, storage or serving of food products or which otherwise may come into contact with or be consumed by people or animals, the metal salt should be selected by taking into consideration the toxicity of the metal. For this purpose, the alkali metal and calcium and magnesium salts are especially preferred since they are generally safe food additives.

The amount of the fatty acid or fatty acid salt stabilizer to achieve the desired enhancement of physical stability will depend on such factors as the nature of the fatty acid or its salt, the nature and amount of the thickening agent, detergent active compound, inorganic salts, other ingredients, as well as the anticipated storage and shipping conditions.

Generally, however, amounts of the fatty acid or fatty acid salt stabilizing agents in the range of from about 0.02 to 2% by weight, preferably 0.04 to 1%, more preferably from about 0.06 to 0.8%, most preferably from about 0.08 to 0.4%, provide a long term stability and absence of phase separation upon standing or during transport at both low and elevated temperatures as are required for a commercially acceptable product. Depending on the amounts, proportions and types of fatty acid physical stabilizers and polycarboxylate thickening agents, the addition of the fatty acid or salt not only increases physical stability, but also provides a simultaneous increase in apparent viscosity. From about 0.08–0.4 weight percent of the metal salt of the fatty acid salt or the fatty acid and from about 0.4–1.5 weight percent of the polymeric thickening agent is usually sufficient to provide these simultaneous benefits and, therefore, the use of these ingredients in these amounts is most preferred.

In order to achieve the desired benefit from the fatty acid or fatty acid salt stabilizer, without stabilization of excess incorporated air bubbles and consequent excessive lowering of the product bulk density, the fatty acid or salt is preferably post-added to the formulation, preferably together with the other surface active ingredients, including detergent active compound and antifoaming agent, when present. These surface active ingredients are preferably added as an emulsion in water, wherein the emulsified oily or fatty materials are finely and homogeneously dispersed throughout the aqueous phase. To achieve the desired fine emulsification of the fatty acid or fatty acid salt and other surface active ingredients, it is usually necessary to heat the emulsion (or preheat the water) to an elevated temperature near the melting temperature of the fatty acid or its salt. For example, for stearic acid having a melting point of 68°–69° C., a temperature in the range of between 50° C. and 71° C. will be used. For lauric acid (m.p.=47° C.) an elevated temperature of about 35° to 50° C. can be used. Apparently, at these elevated temperatures the fatty acid or salt and other surface active ingredients can be more readily and uniformly dispersed (emulsified) in the form of fine droplets throughout the composition.

Foam inhibition is important to increase dishwasher machine efficiency and minimize destabilizing effects which might occur due to the presence of excess foam within the washer during use. Foam may be reduced by suitable selection of the type and/or amount of detergent active material. The degree of foam is also somewhat dependent on the hardness of the wash water in the machine whereby suitable adjustment of the proportions of the builder salts, such as NaTPP which has a water softening effect, may aid in providing a degree of foam inhibition. However, it is generally preferred to include a chlorine bleach stable foam depressant or inhibitor. Particularly effective are the alkyl phosphoric acid esters of the formula:

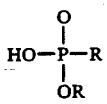

and especially the alkyl acid phosphate esters of the formula:

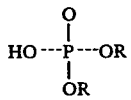

In the above formulas, one or both R groups in each type of ester may represent independently a $C_{12}$–$C_{20}$ alkyl or ethoxylated alkyl group. The ethoxylated derivatives of each type of ester, for example, the condensation products of one mole of ester with from 1 to 10 moles, preferably 2 to 6 moles, more preferably 3 or 4 moles, ethylene oxide can also be used. Some examples of the foregoing are commercially available, such as the products SAP from Hooker and LPKN-158 from Knapsack. Mixtures of the two types, or any other chlorine bleach stable types, or mixtures of mono- and diethers of the same type, may be employed. Especially preferred is a mixture of mono- and di-$C_{16}$–$C_{18}$ alkyl acid phosphate esters such as monostearyl/distearyl acid phosphates 1.2/1, and the 3 to 4 mole ethylene oxide condensates thereof. When employed, proportions of 0.05 to 1.5 weight percent, preferably 0.1 to 0.5 weight percent, of foam depressant in the composition is typical. The weight ratio of detergent active component to foam depressant generally ranges from about 10:1 to 1:1 and preferably about 5:1 to 1:1. In addition, it is an advantageous feature of this invention that many of the stabilizing salts, such as the stearate salts, when included, are also effective as foam depressants.

Although any chlorine bleach compound may be employed in the compositions of this invention, such as dichloroisocyanurate, dichloro-dimethyl hydantoin, or chlorinated TSP, alkali metal or alkaline earth metal, e.g. potassium, lithium, magnesium and especially sodium, hypochlorite is preferred. The composition should contain sufficient amount of chlorine bleach compound to provide about 0.2 to 4.0% by weight of available chlorine. About 0.8 to 1.6% by weight of available chlorine is especially preferred. For example, sodium hypochlorite (NaOCl) solution of from about 11 to about 13% available chlorine in amounts of about 3 to 20%, preferably about 7 to 12%, can be advantageously used.

Detergent active material useful herein should be low-foaming and stable in the presence of chlorine bleach, especially hypochlorite bleach. For this purpose those of the organic aromatic anionic, organic aliphatic anionic, nonionic, amine oxide, phosphine oxide, sulphoxide or betaine water dispersible surfactant types are preferred, wherein anionic surfactants are most preferred. Particularly preferred surfactants are the linear or branched alkali metal mono- and/or di-($C_8$–$C_{14}$)alkyl diphenyl oxide mono- and/or di-sulphates, commercially available for example as DOWFAX (registered trademark) 3B-2 and DOWFAX 2A-1. In addition, the surfactant should be compatible with the other ingredients of the composition. Other suitable organic anionic, non-soap surfactants include the primary alkylsulphates, alkylsulphonates, alkylarylsulphonates and sec.-alkylsulphates. Examples include sodium $C_{10}$–$C_{18}$ alkylsulphates such as sodium dodecylsulphate and sodium tallow alcoholsulphate; sodium $C_{10}$–$C_{18}$ alkanesulphonates such as sodium hexadecylbenzenesulphonates. The corresponding potassium salts may also be employed.

As other suitable surfactants or detergents, the amine oxide surfactants are typically of the structure $R_3R'NO$, in which each R represents a lower alkyl group, for instance, methyl, and R' represents a long chain alkyl group having from 8 to 22 carbon atoms, for instance a lauryl, myristyl, palmityl or cetyl group. Instead of an amine oxide, a corresponding surfactant phosphine oxide $R_2R'PO$ or sulphoxide RR'SO can be employed. Betaine surfactants are typically of the structure $R_2R'N$ R''COO-, in which each R represents a lower alkylene group having from 1 to 5 carbon atoms. Specific examples of these surfactants include lauryl-dimethylamine oxide, myristyldimethylamine oxide, the corresponding phosphine oxides and sulphoxides, and the corresponding betaines, including dodecyldimethylanmonium acetate, tetradecyldiethylammonium pentanoate, hexadecyldimethylammonium hexanoate and the like. For biodegradability, the alkyl groups in these surfactants should be linear, and such compounds are preferred.

Surfactants of the foregoing type, all well known in the art, are described, for example, in U.S. Pat. Nos. 3,985,668 and 4,271,030. If chlorine bleach is not used than any of the well known low-foaming nonionic surfactants such as alkoxylated fatty alcohols, e.g. mixed ethylene oxide-propylene oxide condensates of $C_8$–$C_{22}$ fatty alcohols can also be used.

The chlorine bleach stable, water dispersible or water soluble organic detergent-active material (surfactant) will normally be present in minor amounts, generally about 1% by weight of the composition, although smaller or larger amounts, such as up to about 5%, such as from 0 to 5%, preferably from 0.3 or 0.4 to 2% by weight of the composition, may be used.

Alkali metal (e.g. potassium or sodium) silicate, which provides alkalinity and protection of hard surfaces, such as fine china glaze and pattern, is generally employed in an amount ranging from about 5 to 20 weight percent, preferably about 5 to 15 weight percent, more preferably 8 to 12 weight percent in the composition. The sodium or potassium silicate is generally added in the form of an aqueous solution, preferably having $Na_2O:SiO_2$ or $K_2O:SiO_2$ ratio of about 1:1.3 to 1:2.8, especially preferably 1:2.0 to 1:2.6.

Many of the other components of this composition, especially alkali metal hydroxide and bleach, are also often added in the form of a preliminary prepared aqueous dispersion or solution. However, unless otherwise noted, when amounts of a particular ingredient are given, the reference is to an active ingredient basis, i.e. does not include the aqueous carrier.

In addition to the detergent active surfactant, foam inhibitor, alkali metal silicate corrosion inhibitor, and detergent builder salts, all of which contribute to the cleaning performance, it is also known that the effectiveness of the liquid automatic dishwasher detergent compositions is related to the alkalinity, and particularly to moderate to high alkalinity levels. Accordingly, the compositions of this invention will have pH values of at least about 9.5, preferably at least about 11 to as high as 14, generally up to about 13 or more, and, when added to the aqueous wash bath at a typical concentration level of about 10 grams per liter, will provide a pH in the wash bath of at least about 9, preferably at least about 10, such as 10.5, 11, 11.5 or 12 or more.

The alkalinity will be achieved, in part, by the alkali metal ions contributed by the alkali metal detergent builder salts, e.g. sodium tripolyphosphate, potassium tripolyphosphate and alkali metal silicate, however, it is usually necessary to include alkali metal hydroxide, e.g. NaOH or KOH, to achieve the desired high alkalinity. Amounts of alkali metal hydroxide in the range of from about 0 to 8%, preferably from 1 to 6%, more preferably from about 1.2 to 4%, by weight of the composition will be sufficient to achieve the desired pH level and/or to adjust the K/Na weight ratio.

Other alkali metal salts, such as alkali metal carbonate may also be present in the compositions in minor amounts, for example from 0 to 4%, preferably 0 to 2%, by weight of the composition.

Another often beneficial additive for the present liquid automatic dishwasher detergent compositions is a relatively low molecular weight, non-crosslinked polyacrylic acid, such as the commercial product Acrysol LMW=45N, which has a molecular weight of about 45,000. The low polyacrylic acids can provide additional thickening characteristics but are primarily introduced for their ability to function as a builder or chelating agent. In this capacity, the low molecular weight polyacrylic acids can contribute to reduced spotting or streaking and reduced filming on dishes, glassware, pots, pans and other utensils and appliances. Generally, a suitable molecular weight ranges for the non-crosslinked polyacrylic acid is from about 800 to 200,000, preferably 1000 to 150,000, and more preferably from about 2,000 to 100,000. When present in the formulation, the non-crosslinked polyacrylic acid can be used in amounts up to about 10% by weight, preferably from about 0 to 8% by weight, especially 2 to 6% by weight of the composition.

Other conventional ingredients may be included in these compositions in small amounts, generally less than about 3 weight percent, such as perfume, hydrotropic agents such as sodium benzene sulfonate, toluene sulfonate, xylene sulfonate and cumene sulfonate, preservatives, dyestuffs and pigments and the like, all of course being stable to chlorine bleach compound and high alkalinity. Especially preferred for coloring are the chlorinated phthalocyanines and polysulphides of aluminosilicate which provide, respectively, pleasing green and blue tints. To achieve stable yellow colored products, the bleach stable mixed dyes C.I. Direct Yellow 28 (C.I. 19555) or C.I. Direct Yellow 29 (C.I. 19556) can be added to the compositions. $TiO_3$ may be employed for whitening or neutralizing off-shades.

Although for the reasons previously discussed excessive air bubbles are not often desirable in the invention compositions, depending on the amounts of dissolved solids and liquid phase densities, incorporation of small amounts of finely divided air bubbles, generally up to about 10% by volume, preferably up to about 4% by volume, more preferably up to about 2% by volume, can be incorporated to adjust the visual appearance, product density and flowability. The incorporated air bubbles should be finely divided, such as up to about 100 microns in diameter, preferably from about 20 to 40 microns in diameter. Other inert gases can also be used, such as nitrogen, helium, argon, etc.

The amount of water contained in these compositions should, of course, be neither so high as to produce unduly low viscosity and fluidity, nor so low as to produce unduly high viscosity and low flowability, linear viscoelastic properties in either case being diminished or destroyed by increasing Tan S. The amount of water is readily determined by routine experimentation and generally will range from 30 to 75 weight percent, preferably about 35 to 65 weight percent. Preferably, the water should also be deionized or softened.

In accordance with an especially preferred embodiment, the thickened linear viscoelastic aqueous automatic dishwasher detergent composition of this invention includes, on a weight basis:

(a)

(i) 0 to 35%, preferably 5 to 30% potassium tripolyphosphate detergent builder;

(ii) 0 to 35% sodium tripolyphosphate, preferably 5 to 15%

(b) 0 to 15, preferably 5 to 12%, alkali metal silicate;

(c) 0 to 8%, preferably 1.0 to 6%, alkali metal hydroxide;

(d) 0 to 5%, preferably 0.3 to 5%, chlorine bleach stable, organic detergent-active material, preferably non-soap anionic detergent;

(e) 0 to 1.5%, preferably 0.1 to 0.5%, foam depressant;

(f) chlorine bleach compound in an amount to provide about 0.2 to 4%, preferably 0.8 to 1.6%, of available chlorine;

(g) 0.1 to 5% of a crosslinked copolymer of methyl vinyl ether/maleic anhydride which is cross-linked with 0.5 to 2.5 weight percent of an aliphatic diene having about 6 to about 20 carbon atoms;

(h) 0.02 to 2.0% of a metal salt of a fatty acid or a fatty acid; and (i) water.

The compositions will be supplied to the consumer in suitable dispenser containers preferably formed of molded plastic, especially polyolefin plastic, and most preferably polyethylene, for which the invention compositions appear to have particularly favorable slip characteristics. In addition to their linear viscoelastic character, the compositions of this invention may also be characterized as pseudoplastic gels (nonthixotropic) which are typically near the borderline between liquid and solid viscoelastic gel, depending, for example, on the amount of the polymeric thickener. The invention compositions can be readily poured from their containers without any shaking or squeezing, i.e. have a sufficiently low yield stress value to flow under their own weight (gravity), although squeezable containers are often convenient and accepted by the consumer for gel-like products.

The liquid aqueous linear viscoelastic automatic dishwasher compositions of this invention are readily employed in known manner for washing dishes, other kitchen utensils and the like in an automatic dishwasher, provided with a suitable detergent dispenser, in an aqueous wash bath containing an effective amount of the composition, generally sufficient to fill or partially fill the automatic dispenser cup of the particular machine being used.

The invention also provides a method for cleaning dishware in an automatic dishwashing machine with an aqueous wash bath containing an effective amount of the liquid linear viscoelastic automatic dishwasher detergent composition as described above. The composition can be readily poured from the polyethylene container with little or no squeezing or shaking into the dispensing cup of the automatic dishwashing machine and will be sufficiently viscous and cohesive to remain securely within the dispensing cup until shear forces are again applied thereto, such as by the water spray from the dishwashing machine.

DETAILED DESCRIPTION OF THE PREFERRED EMBODIMENTS

The invention may be put into practice in various ways and a number of specific embodiments will be described to illustrate the invention with reference to the accompanying examples.

EXAMPLE I

A typical synthesis of cross-linked Gantrez is set forth as follows:

In a one liter pressure reactor charge the following (all parts by weight): 404.4 parts cyclohexane, 269.6 parts ethyl acetate, 6 parts 1,7 octadiene. The initiator t-butylperoxypivalate, is added at 58° C. in three increments of 0.1 part each. Each portion is added all at once, not over a period of time. Initiator is added as 0.1 part at times: 0, 60, and 120 minutes of the reaction. Seventy-five parts of molten maleic anhydride and 49.0 parts of methyl vinyl ether are mixed together and added to the reaction vessel at 58° C. and 65 psi. They are fed in over a period of time for 2 to 3 hours. The reaction mixture is held at 58° C. for two hours after the last addition of the initiator. The presence of maleic anhydride is followed by testing with triphenyl phosphene. The product precipitates out of solution (slurry polymerization). After the reaction is complete, the product is filtered and dried in a vacuum oven.

EXAMPLE II

Formulations A–F (Table IV) were prepared by first forming a uniform dispersion of the crosslinked Gantrez AN polymer from Example 1 in about 90% of the water to be added as water in the formula. The Gantrez AN was added to deionized water with agitation. The dispersion was then neutralized by addition of the caustic soda (50% NaOH) component until a thickened product of gel-like consistency was formed.

To the resulting gelled dispersion the silicate, sodium tripolyphosphate (NaTPP), potassium tripolyphosphate (KTPP), the surfactant emulsion (described below), bleach and color, were added sequentially, in the order stated, with the mixing continued at medium shear for several minutes before adding the next ingredient. After the addition of the surfactant emulsion (at 160° F.), the mixture was cooled to 90° F. from 90°–110° F. before the bleach was added.

The surfactant emulsion of the phosphate anti-foaming agent (LPKN), stearic acid or fatty acid mixture and detergent (Dowfax 3B2) was prepared separately by adding these ingredients to the remaining 3% of water (that was not used to disperse the polymer) and heating the resulting mixture to a temperature of about 160° F. (71° C.).

The aging data at 100° F. and 120° F. (Table V) indicates that Formula E is the best out of all the cross-linked Gantrez compositions. Formula F, which contains 5% linear Gantrez separated after 2 weeks, indicates that cross-linking is necessary to achieve stability against separation. All the cross-linked Gantrez formulas had not separated at 77° F., even after almost 5 months.

Table VI contains a summary of available chlorine data of LADD with cross-linked Gantrez. Formula E (most stable against separation per wt of polymer used) exhibits only a 20% loss in available chlorine after 6 weeks at room temperature, and a 30% loss after 3 weeks at 100° F.

Viscosity measurements of the various LADD formulas are summarized in Table VII as a function of time. Viscosity of the cross-linked Gantrez formulas show little or no viscosity loss experienced as a function of aging.

Table VIII contains data on the amount of bottle residue obtained for liquid automatic dishwashing detergent with cross-linked Gantrez and two different versions of a standard commercial automatic dishwashing detergent. The residue left for samples C and D is considerably more (2 times and 1.4 times, respectively) than that of the cross-linked Gantrez when no force is used to dispense the product.

The method for determining the bottle residue was to put test samples in 50 oz Polyethylene bottles. All samples were shaken before being left to equilibrate overnight. Eighty grams is dispensed repeatedly with 2 min rests between doses. The sample is capped and stood upright during the rest periods. No excess force is used until the point when no more product can be dispensed easily. At this time the bottle is shaken and the product is forced out. Grams of bottle residue is reported a) without force and b) with force.

TABLE IV

| | LADD Compositions Containing Gantrez Polymer | | | | | |
|---|---|---|---|---|---|---|
| | A | B | C | D | E | F |
| wt polymer | 2.5 | 2 | 1 | 1.2 | 1.2 | .5 |
| NaOH 50% | 4.5 | 4.5 | 4.5 | 4.6 | 4.5 | 4.5 |
| Na Silicate (1/2.4) | 21.5 | 21 | 21 | 21 | | |
| TKPP | 14.3 | | | | | 14.3 |
| KTPP | 15 | 15 | 15.1 | 15 | 15 | |
| STPP | 11.5 | 10 | 10 | 10 | 10 | 11.5 |
| Graphtol Green | 0.0008 | 0.0012 | 0.0012 | 0.0012 | 0.0012 | 0.0008 |
| Bleach | 11 | 11 | 11 | 11 | 10 | 11 |
| Dowfax 3B2 (45% ai) | 1 | 1 | 1 | 1 | 1 | |
| LPKN | 0.16 | 0.16 | 0.16 | 0.16 | 0.16 | |
| Stearic Acid | 0.1 | 0.1 | 0.1 | 0.1 | 0.1 | |
| wt water | qs | qs | qs | qs | qs | qs |

Tetrapotassium Pyrophosphate (TKPP)
Tetrasodium Pyrophosphate (TSPP)
Sodium tripolyphosphate (STPP)
Potassium Tripolyphosphate (KTPP)

| Composition | Polymer Description |
|---|---|
| A | Gantrez AN cross-linked with 10 wt. % 1,7 Octadiene |
| B | Gantrez AN crosslinked with 5 wt. % 1,7 Octadiene |
| C | Gantrez AN crosslinked with 5 wt. % 1,7 Octadiene |
| D | Gantrez AN/Acrylic Acid Terpolymer crosslinked with 5 wt % 1,7 Octadiene |
| E | Gantrez AN crosslinked with 5 wt. % 1,7 Octadiene |
| F | Linear Gantrez |

TABLE V

| Stability of LADD Formulas Containing Cross-linked Gantrez | | | | |
|---|---|---|---|---|
| | Current status or days to failure | | | |
| Formula % Polymer | 140° F. | 120° F. | 100° F. | 77° F. |
| (A) 2.5% XL Gantrez | | | OK 164 (RT) | |
| (B) 2.0% XL Gantrez | 4 | 14–21 | 63–84 | ok 150 |
| (C) 1.0% XL Gantrez | 4 | 17–21 | 63–84 | OK 150 |
| (D) 1.2% XL Gantrez | 7 | not tested | 40 | Marginal 150 |
| (E) 1.2% XL Gantrez | 7 | 32–40 | OK 85 | OK 150 |

TABLE V-continued

| Stability of LADD Formulas Containing Cross-linked Gantrez | | | | |
|---|---|---|---|---|
| | Current status or days to failure | | | |
| Formula % Polymer | 140° F. | 120° F. | 100° F. | 77° F. |
| (F) 5% Linear Gantrez | | | | 14 (RT) |

OK = continuing to age
n-m = failed between these two times

TABLE VI

| Percent Available Chlorine of LADD Made With Cross-linked Gantrez | | | | | |
|---|---|---|---|---|---|
| Formula, polymer | init. Chl | 1 wk, 77 F. | 3 wk, 77 F. | 4 wk, 77 F. | 6 wk, 77 F. |
| A. 2.5% XL Gantrez | 1.18 | 1.09 | | | |
| B. 2% XL Gantrez | 1.24 | 1.17 | | 1.05 | |
| C. 1% XL Gantrez | 1.24 | 1.17 | | 1.1 | |
| D. Terpolymer | 1.37 | 1.27 | 1.16 | | 1.01 |
| E. 1.2% XL Gantrez | 1.34 | 1.23 | 1.17 | | 1.07 |
| Formula, polymer | | 1 wk, 100 F. | 3 wk, 100 F. | 4 wk, 100 F. | 6 wk, 100 F. |
| B. 2% XL Gantrez | | 1.24 | 0.96 | | 0.71 |
| C. 1% XL Gantrez | | 1.24 | 1.04 | | 0.83 |
| D. Terpolymer | | 1.37 | 1.12 | 0.72 | |
| E. 1.2% XL Gantrez (E) | | 1.34 | 1.15 | 0.79 | |

TABLE VII

| Viscosity of LADD Containing XL Gantrez<br>Viscosities in thousands of centipoises | | | |
|---|---|---|---|
| Number, polymer | init. visc | visc, 77 F., 1 wk | 3 wk, 77 F. |
| B. 2% XL Gantrez | 37.6 | 37.6 | 31.6 |
| C. 1% XL Gantrez | 12.4 | 12 | 12.4 |
| D. 1.2% XL Gantrez | 11.6 | 13.6 | 17.2 |
| Number, polymer | | visc. 100 F. | 3 wk, 100 |
| B. 2% XL Gantrez | | 30.8 | 22.4 |
| C. 1% XL Gantrez | | 9.6 | 8.4 |
| D. Terpolymer AA | | | |
| E. 1.2% XL Gantrez | | 16 | 10.8 |

TABLE VIII

| Bottle Residue of LADD Containing XL Gantrez Compared to commercially available LADD. | | | |
|---|---|---|---|
| #2-Lemon | LADD w/1.2% XL Gantrez | Commercial LADD Sample #1-Regular | Commercial LADD Sample |
| wt resid (grams), no force | 117 | 231 | 162 |
| wt resid (grams), force | 48 | 76 | 65 |

What is claimed is:

1. A linear viscoelastic aqueous liquid gel automatic dishwasher detergent composition comprising water; 0.01 to about 2% by weight of long chain fatty acid or salt thereof, said long chain fatty acid or said salt thereof causing an increase in the apparent viscosity of said linear viscoelastic aqueous gel composition; from about 0 to 5% by weight of low foaming, non soap, chlorine stable organic detergent; from about 5 to 40% by weight of alkali metal detergent builder salt, said builder salt being selected from the group consisting essentially of carbonates, phosphates, borates and alumino silicates; a chlorine bleach compound in an amount to provide 0.2 to 4% by weight of available chlorine; and 0.1 to 5.0% of a crosslinked copolymer of methyl vinyl ether and maleic anhydride which is crosslinked with at least about 0.5 wt % of a crosslinking agent selected from the group consisting essentially of an aliphatic diene having about 6 to about 20 carbon atoms and substituted aliphatic dienes having ester, ether or hydroxyl groups and having 6 to 20 carbon atoms, said composition having a G''/G'' value of less than one.

2. The composition of claim 1, wherein the long chain fatty acid or salt thereof is present in an amount of from about 0.01 to 0.8% by weight.

3. The composition of claim 1 which further comprises 5 to 20 wt. of an alkali metal silicate anti-corrosion agent.

4. The composition of claim 3 which further comprises 0.05 to 1.5 wt. % of an anti-foaming agent.

5. The composition of claim 1 which comprises, approximately:

(a) 5 to 40 wt % of said builder salt, said builder salt being at least one alkali metal tripolyphosphate;
(b) 0 to 30 wt % of an alkali metal silicate;
(c) 0 to 6 wt % of an alkali metal hydroxide;
(d) 0.1 to 5 wt % of said detergent active material;
(e) 0 to 0.5 wt % of said foam depressant;
(f) said chlorine bleach compound in an amount to provide 0.8 to 1.6% of available chlorine;
(g) 0.2 to 5 wt % of said crosslinked copolymer of methyl vinyl ether/maleic anhydride or a terpolymer of methyl vinyl ether/maleic anhydride/acrylic acid;
(h) 0.2 to 2.0 wt % of said fatty acid or said metal salt of said fatty acid, said fatty acid having from about 18 to about 36 carbon atoms; and
(i) 0 to 8 wt % of a non-crosslinked polyacrylic acid having a molecular weight of from about 1,000 to 150,000.

6. The composition of claim 5, wherein in which the chlorine bleach compound is sodium hypochlorite.

7. The composition of claim 5 said composition satisfying the following stability criteria for at least 20 weeks at ambient temperature and for at least 1 week at 140° F.: substantially no phase separation, substantially no change in dynamic-mechanical properties, no crystal growth, no significant color change and less than about 10 wt % cup leakage.

* * * * *